US010207519B2

(12) United States Patent
Breintner et al.

(10) Patent No.: US 10,207,519 B2
(45) Date of Patent: Feb. 19, 2019

(54) METHOD TO DETERMINE AND/OR COMPENSATE FOR EFFECTS OF THE DEFORMATION OF A RECORDING MEDIUM

(71) Applicant: Océ Holding B.V., Venlo (NL)

(72) Inventors: Tobias Breintner, Munich (DE); Daniel Denzinger, Erding (DE); Frank Keidel, Poing (DE); Stefan Scherdel, Markt Schwaben (DE)

(73) Assignee: Océ Holding B.V., Venlo (NL)

( * ) Notice: Subject to any disclaimer, the term of this patent is extended or adjusted under 35 U.S.C. 154(b) by 0 days.

(21) Appl. No.: 15/879,211

(22) Filed: Jan. 24, 2018

(65) Prior Publication Data

US 2018/0207957 A1 Jul. 26, 2018

(30) Foreign Application Priority Data

Jan. 24, 2017 (DE) ..... 10 2017 101 251

(51) Int. Cl.

| | |
|---|---|
| ***B41J 11/00*** | (2006.01) |
| ***B65H 23/188*** | (2006.01) |
| ***B41J 2/01*** | (2006.01) |
| ***B41J 15/16*** | (2006.01) |

(52) U.S. Cl.

CPC ..... *B41J 11/0005* (2013.01); *B41J 2/01* (2013.01); *B41J 15/16* (2013.01); *B65H 23/188* (2013.01); *B65H 2513/10* (2013.01); *B65H 2515/31* (2013.01); *B65H 2801/15* (2013.01)

(58) Field of Classification Search

CPC ..... B41J 2/01; B41J 11/0005; B41J 15/16; B65H 23/188; B65H 2513/10; B65H 2513/31; B65H 2515/31; B65H 2801/15

See application file for complete search history.

(56) References Cited

U.S. PATENT DOCUMENTS

| | | | | |
|---|---|---|---|---|
| 4,721,969 | A | 1/1988 | Asano | |
| 5,485,386 | A | 1/1996 | Andreasson | |
| 5,707,709 | A * | 1/1998 | Blake | A41D 31/02 112/413 |
| 7,127,992 | B2 * | 10/2006 | Damm | B41F 17/26 101/474 |
| 7,607,660 | B2 * | 10/2009 | Inoue | B65H 9/002 271/228 |

FOREIGN PATENT DOCUMENTS

| | | | |
|---|---|---|---|
| DE | 69114302 | T2 | 5/1996 |
| DE | 10137258 | A1 | 2/2003 |
| DE | 102009051197 | A1 | 5/2011 |
| DE | 102013214016 | A1 | 1/2015 |
| DE | 102014013370 | A1 | 3/2016 |
| EP | 0951993 | A1 | 10/1999 |

OTHER PUBLICATIONS

German Search Report dated Jul. 19, 2017—German application No. 10 2017 101 251.6.

* cited by examiner

*Primary Examiner* — Anh T. N. Vo
(74) *Attorney, Agent, or Firm* — Schiff Hardin LLP

(57) ABSTRACT

In a printer having first and second clamps, the deformation of a recording medium due to the web tensile force produced in the printer can be determined using the first and the second clamps. The deformation can be determined in advance of a printing process and/or during the printing operation. A print image can be adapted based on the determined deformation to compensate for the deformation of the recording medium.

14 Claims, 3 Drawing Sheets

Figure 1:
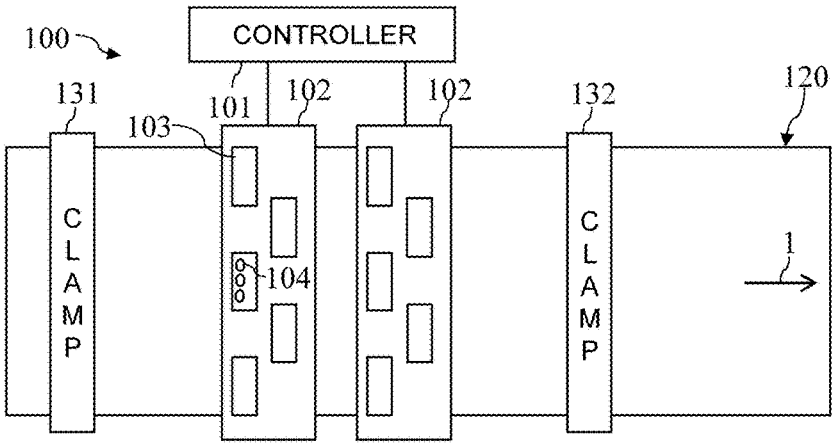

METHOD TO DETERMINE AND/OR COMPENSATE FOR EFFECTS OF THE DEFORMATION OF A RECORDING MEDIUM

CROSS REFERENCE TO RELATED APPLICATIONS

This patent application claims priority to German Patent Application No. 102017101251.6, filed Jan. 24, 2017, which is incorporated herein by reference in its entirety.

BACKGROUND

The disclosure relates a method to determine the deformation of a web-shaped recording medium in a digital printer. Furthermore, the disclosure relates to a method to compensate for effects of the deformation of a recording medium in a printer, including compensating for effects on a print image to be printed.

A digital printer, for example an inkjet printer, may be used to print to a web-shaped recording medium. The recording medium may thereby be flexible and elastic, such as for plastic films or textiles. Upon printing to a flexible recording medium, the recording medium may deform substantially under tension. In particular, the recording medium may be substantially stretched by the web tensile force that is applied to convey the web-shaped recording medium through the printer. As a result of the stretching of the recording medium, distortions may occur of the print image that is printed onto the stretched recording medium.

To compensate for distortions of a print image, in DE 10 2009 051 197 A1 a correction method for a digital printing process was described in which the print image is adapted to the deformation of the recording medium in a printer via a calculation algorithm. The algorithm uses a deformation factor as an input value, wherein the deformation factor is determined by printing a ruler onto the recording medium and by measurement of the printed ruler by a user, or via an optical sensor. In U.S. Pat. No. 4,721,969 A, register marks are used to determine register errors, wherein the register marks are detected with CCD (Charged Coupled Device) sensors.

In the two aforementioned documents, a printed mark is used in order to determine the deformation of a recording medium. This requires a dedicated printing process for printing a marking for the determination of the deformation of the recording medium, and thus is linked with additional time and resource costs.

DE 691 14 302 T2 describes a method to monitor the lengthening of a running belt. DE 101 37 258 A1 describes a method to determine a characteristic tension/stretching line of a material web. EP 0 951 993 A1 describes a method to determine the longitudinal stretching of a paper web. DE 10 2013 214 016 A1 describes a method for correction of a print image by an extension factor. DE 10 2014 013 370 A1 describes a method for compensation of local register inaccuracies.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 2A:
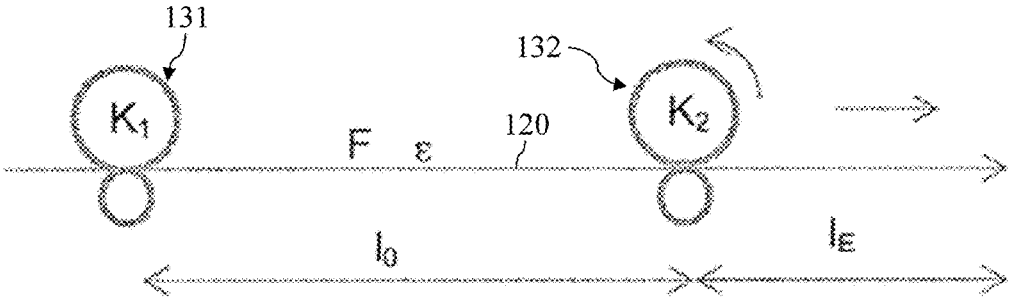
Figure 2B:
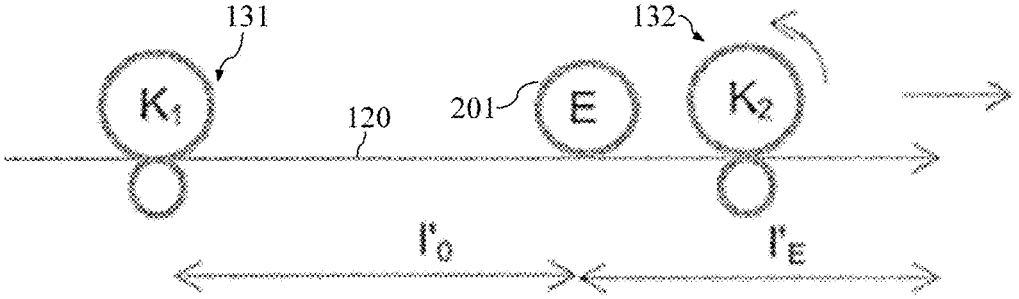
Figure 2C:
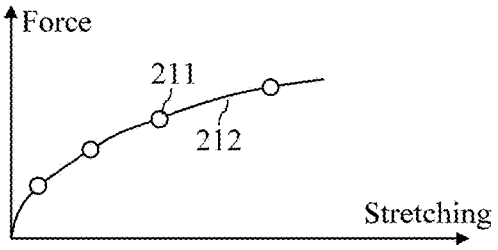
Figure 3A:
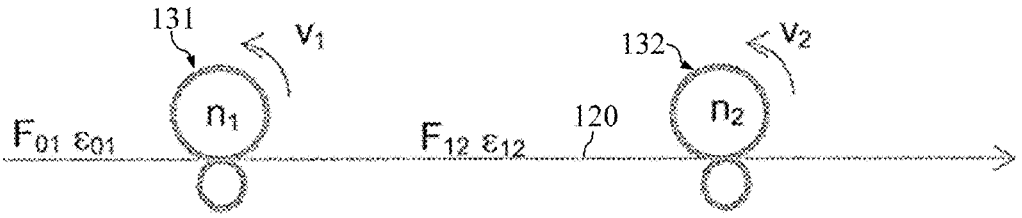
Figure 3B:
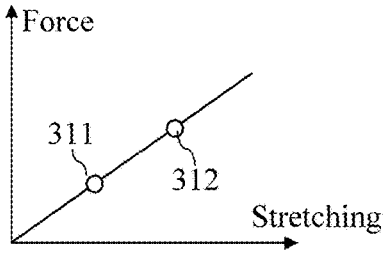
Figure 4:
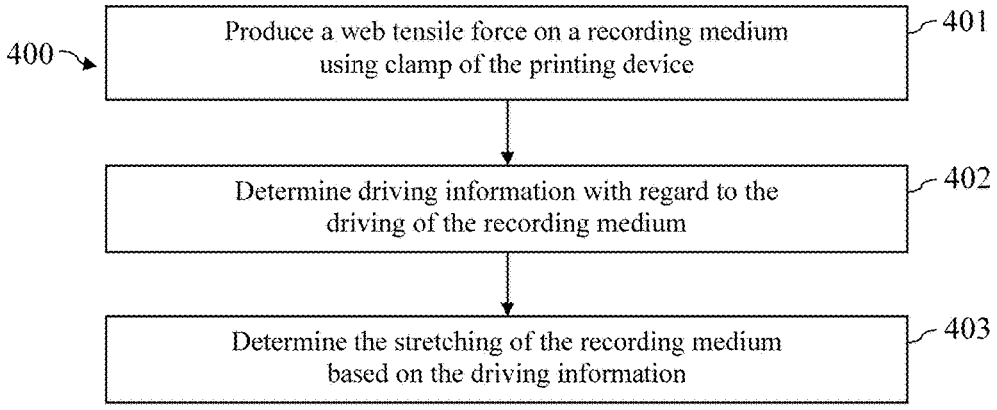

FIG. 1 illustrates a block diagram of an inkjet printer according to an exemplary embodiment of the present disclosure;

FIGS. 2*a*, 2*b* illustrate examples of measurement values to ascertain the web stretching according to exemplary embodiments of the present disclosure;

FIG. 2*c* illustrates a graphical representation of a characteristic line for the web stretching according to an exemplary embodiment of the present disclosure;

FIG. 3*a* illustrates examples of measurement values to ascertain the web stretching according to an exemplary embodiment of the present disclosure;

FIG. 3*b* illustrates a graphical representation of a characteristic line for the web stretching in the Hooke's range according to an exemplary embodiment of the present disclosure; and FIG. 4 illustrates a flowchart of a method to ascertain the stretching of a web-shaped recording medium according to an exemplary embodiment of the present disclosure.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide a method and a device with which the deformation of a recording medium in a printer may be efficiently and reliably determined and compensated for.

According to one aspect, a method is described for determining the deformation of a recording medium in a printer. In an exemplary embodiment, the printer includes a first clamp that is arranged before a print group of the printer and a second clamp that is arranged after the print group. In an exemplary embodiment, the method includes the production of a web tensile force on the recording medium between the first clamp and the second clamp by driving the recording medium by the first clamp and/or by the second clamp. Moreover, the method includes the detection of driving information with regard to the driving of the recording medium. Furthermore, the method includes the determination of stretching information with regard to a stretching of the recording medium between the first clamp and the second clamp on the basis of the driving information.

According to a further aspect, a method is described to compensate for the effect of a deformation of a recording medium in a printer. The method includes the determination of stretching information with regard to the stretching of the recording medium in the print group. The stretching information may thereby be determined via the method described in this document for ascertaining the deformation of a recording medium. Moreover, the method includes the adaptation of a print image to be printed by the print group depending on the stretching information. Effects of the deformation of the recording medium on the print image to be printed may thus be compensated.

The present disclosure relates to an efficient and reliable determination of the stretching of a web-shaped recording medium in a digital printer. The determination can be enabled within the printer, and in one or more aspects, during the running printing operation.

FIG. 1 shows a block diagram of an inkjet printer 100 according to an exemplary embodiment of the present disclosure. In an exemplary embodiment, the printer 100 is configured for printing to a web-shaped recording medium 120 (also referred to as a "continuous feed"). In an exemplary embodiment, the recording medium 120 is taken off a roll (using a takeoff) and then supplied to the print group of the printer 100. A print image is applied onto the recording medium 120 by the print group, and the printed-to recording medium 120 is taken up again (possibly after fixing/drying of the print image) on an additional roll (using a takeup). Alternatively, the printed-to recording medium 120 may be cut into sheets or pages by a cutting device, for example. In FIG. 1, the transport direction 1 of the recording medium 120 is represented by an arrow 1. The present disclosure is not limited to inkjet printing technologies and the embodiments herein can be applied to other printers and/or printing technologies, such as toner-based printers, or other printers/printing technologies as would be understood by one of ordinary skill in the relevant arts.

In an exemplary embodiment, the print group of the printer 100 includes two print bars 102 that are spaced apart from one another in the transport direction 1, respectively having multiple print heads 103. The different print bars 102 may be configured to print with inks of different colors (e.g. black, cyan, magenta and yellow). The print group may also include additional print bars 102 to print with additional colors or fluids (such as primer or magnetic ink character recognition (MICR) ink).

In an exemplary embodiment, each print head 103 includes multiple nozzles 104 as an example of image point generators. The nozzle(s) 104 are configured to fire ink droplets onto the recording medium 120. For example, a print head 103 may include 2558 or 5312 effectively utilized nozzles 104 that are arranged along one or more rows transversal to the transport direction 1 of the recording medium 120. A respective row may be printed on the recording medium 120, transversal to the transport direction 1, by the nozzles 104 of a print head 103. In total, for example, K=12790 or K=26560 droplets are fired along a row onto the recording medium 120 via a print bar 102 depicted in FIG. 1 (for example, for a print width of approximately 56 cm at 600 dpi or 1200 dpi (dots per inch)).

In an exemplary embodiment, the printer 100 additionally includes a controller 101 (for example an activation hardware and a controller) that is configured to activate the actuators of the individual nozzles 104 of the individual print heads 103 based on print data to apply a print image onto the recording medium 120. The controller 101 can be, for example activation hardware in one or more aspect. In an exemplary embodiment, the controller 101 includes processor circuitry that is configured to perform one or more operations and/or functions of the controller 101, including, for example, the activation of the actuator(s) based on the print data.

In an aspect, the printer 100 includes least one print bar 102 having K nozzles 104 that may be activated with a specific line signal in order to print a row (transversal to the transport direction 1 of the recording medium 120) with K image points or K columns onto the recording medium 120. In the depicted example, the nozzles 104 are installed immobile or fixed in the printer 100, and the recording medium 120 is directed past the stationary nozzles 104 with a defined transport velocity (for example 80 m/min). A defined nozzle 104 may print the image points of a corresponding column traveling in the transport direction 1 onto the recording medium 120. This configuration is referred to as a 1:1 association, since precisely one nozzle 104 is associated with each column and precisely one column is associated with each nozzle 104.

In an exemplary embodiment, the printer 100 also includes at least two clamps 131, 132 that are configured to hold and convey the web-shaped recording medium 120 at the input of the print group via the first clamp 131, and at the output of the print group via the clamp 132. The clamps 131, 132 can be motorized clamps in one or more embodiments. If the clamp 132, in particular, a roller of the clamp 132, rotates slightly faster upon transport of the recording medium 120 than the clamp 131, a web tensile force on the recording medium 120 may be produced to tension the recording medium 120 within the print group. In an exemplary embodiment, the contact pressure force of roller pairs of the two clamps 131, 132 may be adjusted to be of corresponding magnitude. Consequently, a web tensile force may be produced via a velocity difference between the roller pairs of the two clamps 131, 132. The level of the web tensile force can be dependent on the level of the velocity difference. In an exemplary embodiment, the web tensile force increases with increasing velocity difference. A roller pair of a clamp 131, 132 may thereby comprise one hard roller for driving the recording medium 120 and one soft roller for pressing the recording medium 120 against the hard roller.

In an exemplary embodiment, via the clamps 131, 132, it may thus be produced that the recording medium 120 has a defined web tensile stress within the print group. Within the print group, a print image may thus be printed precisely onto the recording medium 120. However, the recording medium 120 may be stretched by the web tensile stress, which may lead to distortions of the print image at the output of the printer 100.

In the following, methods are described with which the deformation of the recording medium 120 due to the web tensile force may be determined in a printer 100 without printing a marking. The determined deformation may then be compensated for, for example with the correction method described in DE 10 2009 051 197 A1.

For example, before the start of a printing process with a specific recording medium 120 or with a specific type of recording medium 120, the deformation of the recording medium 120 may be determined upon loading the recording medium 120 with a web tensile force F. In principle, a tension test may thereby be implemented in which a deformation, in particular a stretching $\varepsilon$, of the recording medium 120 is caused via an applied force F. The tension test may thereby be implemented within the printer 100, or possibly also outside of the printer 100 (for example at a separate material testing machine).

The deformation of the recording medium 120 that is determined in such a manner may be compensated via adaptation of the print image that is printed onto the recording medium 120 in the digital printer 100 (for example with the correction method described in DE 10 2009 051 197 A1). In particular, the print image to be printed may be elongated in the transport direction 1, depending on the determined stretching ε of the recording medium 120, in order to compensate for a contraction of the recording medium 120 that takes place after removal of the web tensile force F.

In an exemplary embodiment, the clamps 131, 132 of the printer 100 may be used to determine the deformation within the printer 100. In an exemplary embodiment, the clamps 131, 132 are configured for elastic slippage (stretching under slippage). In this example, the roller nips of the two clamps 131, 132 then respectively form clamping points at which the recording medium 120 may be firmly clamped. In an exemplary embodiment, the clamps 131, 132 are configured to ensure that the recording medium 120 does not slip through a roller nip given the web tensile force F that is used. That is, the clamps 131, 132 are configure such that the recording medium 120 moves with the rollers of the clamps 131, 132.

In an exemplary embodiment, the clamps 131, 132 are configured to develop the web tensile force F. For example, a roller may be used in combination with negative pressure to develop the web tensile force F in the print group. Alternatively or additionally, the clamps 131, 132 may respectively comprise an S-draw or Ω-draw. Given an S-draw, the recording medium 120 is directed around two rollers so that the path of the recording medium 120 describes the letter "S". Given an Ω-draw, the recording medium 120 is directed around three rollers in total (two relatively small rollers and one relatively large roller) so that the path of the recording medium 120 describes the letter "Ω". In these examples, the recording medium 120 may be held (even without the use of a roller nip) in order to develop a web tensile force F. To determine the deformation, it is thereby advantageous that no relative velocity occurs between the clamps 131, 132 and the web-shaped recording medium 120.

Using the clamps 131, 132, the deformation of the recording medium 120 may be determined within the printer 100 and, in one or more aspects, during the printing process. In an exemplary embodiment, a currently determined deformation of the recording medium 120 may then be used for dynamic adaptation of the print image to be printed to the currently determined deformation of the recording medium 120. Variations of the stretching of the web-shaped recording medium 120 to be printed to that would otherwise affect the print quality may thus be compensated for dynamically in the running operation of the printer 100. Furthermore, the determination of the deformation within a printer 100 has the advantage that even recording media 120 made from unknown materials or with unknown deformation properties may be used in the printer 100.

The recording medium 120 may initially be located in an un-tensioned state in the printer 100, in particular between the two clamps 131, 132 of the printer 100 (for example directly after the insertion of the recording medium 120 into the printer 100).

The web-shaped recording medium 120 may then be secured with the first clamp 131 as illustrated in FIG. 2*a*, whereas at the second clamp 132 the recording medium 120 is conveyed out of the printer 100 via a (typically electric) drive of the clamp 132. As soon as the web-shaped recording medium 120 is tensioned, the web tensile force F on the recording medium 120 increases given additional transport of the recording medium 120. The web tensile force F in the printer 100 is determined, possibly continuously, via a web tension measurement device during the further transport. As soon as a desired web tensile force F is achieved (for example the web tensile force F that is also used during the printing process), the drive of the second clamp 132 is stopped.

Via a rotary sensor or an encoder at the conveying clamp 132, for example via a rotary sensor at a roller and/or at a motor of the clamp 132, it may be determined what transport length $l_E$ of the recording medium 120 has been transported from the printer 100 since the tensioning of the recording medium 120 (with the web tensile force F=0). On the other hand, the reference length $l_0$ of a recording medium 120 within the printer 100 is typically hard-set via the geometry of the printer 100, in particular via the distance of the two clamps 131, 132. The stretching or deformation ε of the recording medium 120 may then be determined as $\varepsilon = l_E / l_0$.

In an exemplary embodiment as depicted in FIG. 2*b*, the rotary sensor 201 is not located at the second clamp 132 but rather at a rotary sensor roller driven by the recording medium 120 and arranged between the clamps 131, 132, which rotary sensor roller follows the movement of the web-shaped recording medium 120. In the calculation of the stretching ε, the entire reference length or web length $l_0$ between the clamps 131, 132 is then not taken into account, but rather the intermediary reference length or web length $l'_0$ between the stationary first clamp 131 and the rotary sensor roller (labeled with E in FIG. 2*b*). The stretching ε then results as a quotient of the transport length $l'_E$, which is determined using the rotary sensor 201, and the intermediary reference length $l'_0$, meaning $\varepsilon = l'_E / l'_0$.

A printer 100 may enable a user to flexibly adjust the web tensile force F before or during the printing process, for example to increase or reduce it. In an exemplary embodiment, for this purpose, the speed of the second clamp 132 may be varied. The stretching ε of the recording medium 120 also typically changes due to the changing of the web tensile force F. In an exemplary embodiment, the stretching ε may now be determined in advance of a printing process for a multitude of different web tensile forces F. The web tensile force F, and the stretching ε determined for this, thereby represent a measurement point 211 of a characteristic force/stretching line 212. In an exemplary embodiment, the characteristic force/stretching line 212 may be determined via determination of a plurality of measurement points 211, for example using an interpolation between the measurement points 211 and/or using a regression method. The measurement points 211 may thereby be determined by progressively increasing the web tensile force F and via progressive determination of the transport lengths $l_E$ or $l'_E$.

The characteristic force/stretching line 212, or a corresponding force/stretching table, may then be used in the printing operation of the printer 100 to determine the corresponding stretching or deformation of the recording medium 120 for a currently set web tensile force F. A flexible adaptation of the web tensile force F in a printer 100 is thus enabled. In particular, the printer 100 may use a characteristic force/stretching line 212 or a corresponding force/stretching table to adapt a print image to be printed depending on a set web tensile force F.

In an exemplary embodiment, the determination of the characteristic force/stretching line 212 or of the force/stretching table of a recording medium 120 can be additionally or alternatively performed outside of a printer 100, for example, in a material testing machine. Characteristic lines 212 for various types of recording media 120, for example recording media 120 made from various materials, may thereby be recorded and stored in advance. The recorded characteristic lines 212 or tables may be provided to the controller 101 of a printer 100. The type of recording medium 120 that is to be used may then be selected before the printing operation. Corresponding to the type selection, the controller 101 of the printer 100 may then use the associated characteristic force/stretching line 212 or force/stretching table to adapt a print image to be printed to the web tensile force F used in the printer 100. However, it is thereby typically necessary that a characteristic force/stretching line 212 for the type of recording medium 120 used has already been determined in advance outside of the printer 100.

In an exemplary embodiment, in addition to the stretching c in the transport direction 1 of the recording medium, i.e. in the longitudinal direction, the contraction of the recording medium 120 in the transversal direction, i.e. transversal to the transport direction 1, may be determined via one or more sensors (e.g. via edge sensors). The contraction may likewise be recorded depending on the web tensile force F, for example as a characteristic force/contraction line or force/contraction table. A deformation factor in the transversal direction results from the contraction. If the transversal contraction number, meaning the Poisson ratio, is known for a specific type of recording medium 120, the detection of the lateral contraction via one or more sensors may be omitted since the contraction may then be calculated from the determined stretching ε.

In an exemplary embodiment, the contraction of the recording medium 120 given a web tensile force F used during a printing process may likewise be taken into account in the adaptation of a print image to be printed. In other words, the print image may additionally be dynamically adapted to a deformation in the transversal direction. The print quality upon printing to flexible recording media may thus be further improved.

Some recording media 120 deform continuously under the effect of a web tensile force F, meaning that plastic deformation and/or creep occur. As a result of this, after the application of a web tensile force F via which the stretching $\varepsilon_1$ is produced, a stretching $\varepsilon_2$ remains after subsequent relaxation. If the print image to be printed were scaled corresponding to the stretching $\varepsilon_1$, after the relaxation of the recording medium 120 the print image would then be too long in the longitudinal direction. However, the compensation of the print image to be printed should take place such that the print image has the desired dimensions in the un-tensioned state after leaving the printer 100.

Therefore, the web tensile force F may be decreased again after application of the web tensile force F and after measurement of the deformation or stretching 61. As a result of this, the transport length $l_E$ or $l'_E$ that is determined given the web tensile force F is reduced again; however, a reduced transport length $l_x$ or $l'_x$ will remain due to the remaining deformation. From the reduced transport length $l_x$ or $l'_x$, the deformation or stretching $\varepsilon_2=l_x/l_0$ or $\varepsilon_2=l'_x/l'_0$ in the relaxed state may then be determined. As described above, the transport length may thereby be determined with a measuring tape or via the recording of the rotary sensor movement in the printer 100. The difference of the deformation or stretching $\varepsilon_1$-$\varepsilon_2$ is then used to compensate for a print image to be printed, such that a remaining deformation of the recording medium 120 may be precisely taken into account.

The deformation under load may be at least proportionally time-dependent, which is typically referred to as "creep". As a result of this, in a running printing operation different stretching may result than in a tensile test that is performed in or outside of the printer 100. In an exemplary embodiment, during the printing process, the traversal time of the recording medium 120 through the printer 100, in particular the traversal time of the recording medium 120 from the first clamp 131 to the second clamp 132, may be determined from the geometry of the printer 100 and from the transport velocity of the recording medium 120. The traversal time during the printing process may then be used to determine the stretching of the recording medium 120 during the printing process. In particular, a stretching value that is determined in a tensile test may be adapted depending on the traversal time. The accuracy of the adaptation of a print image to be printed to the deformation of a recording medium 120 may be further increased by taking into account the actual traversal time.

During the printing process, disruptions may be caused due to changes in the properties of a recording medium 120, for example the thickness and/or the modulus of elasticity. For example, changes in the properties of the recording medium 120 to be printed to may lead to fluctuations in the web tensile force in the printer 100 if no regulation of said web tensile force or web tensile stress takes place. Fluctuations of the web tensile force F may lead to fluctuations in the stretching of the recording medium 120, and thus to distortions of a printed print image.

In an exemplary embodiment, during the printing process, the current web tensile force may therefore be measured continuously or periodically. Using a predetermined characteristic force/stretching line 212 or force/stretching table for the recording medium 120, the current stretching may then be determined for the currently measured web tensile force and be taken into account in the correction of the print image to be printed. Variations of properties of the recording medium 120 may thus be precisely compensated for.

In an exemplary embodiment, the deformation of the recording medium 120 may alternatively or additionally be determined by a web guide model in printers 100, with and without web tensile force regulation.

FIG. 3*a* shows a first roller $n_1$ of the first clamp 131, which in a printing process rotates with a first velocity $v_1$, in particular with a first tangential velocity $v_1$, and a second roller $n_2$ of the second clamp 132, which in a printing process rotates with a second (tangential) velocity $v_2$. In the transport direction 1, before the first clamp 131, a first web tensile force $F_{01}$ acts on the recording medium 120 and there produces a first stretching $\varepsilon_{01}$ of said recording medium 120. A second web tensile force $F_{12}$ acts on the recording medium 120 between the first clamp 131 and the second clamp 132, and there produces a second stretching $\varepsilon_{12}$ of the recording medium 120. It applies that:

$$\frac{v_1}{1+\varepsilon_{01}} = \frac{v_2}{1+\varepsilon_{12}},$$

which may be reformulated as follows:

$$\varepsilon_{12} = \frac{v_2}{v_1} * (1+\varepsilon_{01}) - 1$$

If the stretching $\varepsilon_{01}$ in the printer 100 is small and can be ignored, the $\varepsilon_{12}$ of the recording medium 120 in the printer 100—i.e. between the two clamps 131, 132—may be calculated directly from the velocities $v_1$, $v_2$ of the recording medium 120 at the clamps 131, 132. These velocities may be determined with the aid of rotation sensors at the rollers $n_1$, $n_2$ of the clamps 131, 132 and/or at the motors of the clamps 131, 132. A determination of the current web tensile force F during the printing operation is then unnecessary, and the print image to be printed may also be dynamically compensated without force measurement. The accuracy of the deformation compensation may thus be further increased. In particular, a dynamic compensation of current web tensile forces and/or stretching values will thus take place.

In an exemplary embodiment, should the first stretching $\varepsilon_{01}$ before intake into the printer 100 not be negligible, the first stretching $\varepsilon_{01}$ may be determined, for example via a predetermined characteristic force/stretching line 212 of the recording medium 120 and via a measurement of the first web tensile force $F_{01}$. The characteristic force/stretching line 212 of the recording medium 120 may thereby be determined using the method described in this document.

In an exemplary embodiment, alternatively or additionally, the first stretching $\varepsilon_{01}$ may be determined in the running operation.

$$\varepsilon_{12} = \frac{v_2}{v_1} * (1 + \varepsilon_{01}) - 1 = \frac{v_2(1 + \varepsilon_{01})}{v_1} - 1$$

results via reformulation of the aforementioned formula for the second stretching $\varepsilon_{12}$.

In an exemplary embodiment, the second velocity $v_2$, meaning the tangential velocity, of the second roller $n_2$ may be determined from the second angular velocity $\omega_2$ of the second roller $n_2$ and the radius $r_2+\Delta r_2$ of the second roller $n_2$, wherein $r_2$ is the nominal radius and $\Delta r_2$ is an unknown production variance. $v_2=\omega_2*(r_2+\Delta r_2)$ thereby applies, and it results that $$\varepsilon_{12} = \frac{\omega_2(r_2 + \Delta r_2 + \varepsilon_{01} r_2 + \varepsilon_{01}\Delta r_2)}{v_1} - 1 = \frac{\omega_2(r_2 + k)}{v_1} - 1$$

$$\text{with } k = \Delta r_2 + \varepsilon_{01} r_2 + \varepsilon_{01}\Delta r_2$$

$$\text{for constant } \Delta r_2, \varepsilon_{01}, r_2, \Delta r_2$$

An inexactly known diameter or radius at the second roller $n_2$, i.e. $\Delta r_2$, consequently acts in the same manner on the stretching $\varepsilon_{12}$ of the recording medium 120 in the printer 100 as the pre-stretching $\varepsilon_{01}$ of the recording medium 120 before the first clamp 131. The influence may be summarized by a correction factor k.

In an exemplary embodiment, to determine the correction factor k for a recording medium 120, the boundary condition may be utilized where the second stretching $\varepsilon_{12}=0$ for a second web tensile force $F_{12}=0$. Since no web travel is possible with $F_{12}=0$, a measurement of the stretching $\varepsilon_{12}$ may be implemented for at least two different web tensile forces $F_{12}$ in order to obtain the measurement points 311, 312 (see FIG. 3*b*). A stretching value $\varepsilon$ for $F_{12}=0$ may then be extrapolated on the basis of the measurement points 311, 312 for different web tensile forces $F_{12}$ of the recording medium 120 between the clamps 131, 132. It may thereby be taken into account that the characteristic force/stretching line of a material is a straight line in the Hooke's range.

In an exemplary embodiment, the linear equation for the characteristic force/stretching line is as follows:

$$F = \frac{F_2 - F_1}{\varepsilon_2 - \varepsilon_1}(\varepsilon - \varepsilon_1) + F_1$$

thus results from the first measurement point ($F_1$, $\varepsilon_1$) and the second measurement point ($F_2$, $\varepsilon_2$). Under consideration of the boundary condition $F(\varepsilon=0)=0$, $$\frac{F_2 - F_1}{F_1} = \frac{\varepsilon_2 - \varepsilon_1}{\varepsilon_1}$$

then results from the linear equation.

In an exemplary embodiment, for the two measurement points, it then results from the aforementioned formulas that $$\varepsilon_1 = \frac{\omega_{2,1}(r_2 + k)}{v_{1,1}} - 1 = \frac{\omega_{2,1}(r_2 + k)}{\omega_{1,1} r_1} - 1$$

$$\varepsilon_2 = \frac{\omega_{2,2}(r_2 + k)}{\omega_{1,2} r_1} - 1,$$

wherein $\omega_{2,1}$ is the angular velocity of the second roller $n_2$ for the first measurement point, $\omega_{1,1}$ is the angular velocity of the first roller $n_1$ for the first measurement point, $\omega_{2,2}$ is the angular velocity of the second roller $n_2$ for the second measurement point, and $\omega_{1,2}$ is the angular velocity of the first roller $n_1$ for the second measurement point. $r_1$ is the nominal radius of the first roller $n_1$, and $r_2$ is the nominal radius of the second roller $n_2$.

In an exemplary embodiment, the formulas for the two stretching values $\varepsilon_1$ and $\varepsilon_2$ may then be inserted into the linear equation in relation to the forces of the measurement values so that the following formula results:

$$\frac{F_2 - F_1}{F_1} = \frac{\dfrac{\omega_{2,1}}{\omega_{1,1} r_1} - \dfrac{\omega_{2,2}}{\omega_{1,2} r_1}}{\dfrac{\omega_{2,2}}{\omega_{1,2} r_1} - \dfrac{1}{(r_2 + k)}},$$

which may be solved for the correction factor k. The correction factor k may thus be determined on the basis of at least two measurement values during the printing operation.

Via the compensation described above, it is also brought about that production tolerances of the rollers $n_1$, $n_2$ that may—due to the similarity of the two tangential velocities $v_1$ and $v_2$—substantially affect the measurement accuracy may be compensated for by the correction factor k.

FIG. 4 shows a flowchart of method 400 to determine the deformation of a recording medium 120 in a printer 100. The recording medium 120 may thereby be in the form of a web and may, for example, be taken off a roll and directed through the printer 100 in a transport direction 1. The printer 100 comprises a print group, for example one or more inkjet print bars 102 that are set up to print a print image onto the recording medium 120. The printer 100 additionally comprises a first clamp 131 that is arranged before the print group of the printer 100 in the transport direction 1 of the recording medium 120 and a second clamp 132 that is arranged after the print group in the transport direction 1.

In an exemplary embodiment, the first clamp 131 and/or second clamp 132 include rollers that respectively form a roller nip through which the recording medium 120 is directed. The rollers of the second clamp 132 may thereby pull the recording medium 120 through the print group and thereby produce a web tensile force on the recording medium 120. Furthermore, the first clamp 131 may also comprise rollers that form a roller nip through which the recording medium 120 is directed. The first clamp 131 may be set up to at least partially restrain the recording medium 120 in order to produce the web tensile force on said recording medium 120. In a printing operation of the printer 100, the first clamp 131 and the second clamp 132 may produce a defined web tensile force so that the recording medium 120 is tensioned in the print group and thus may be reliably printed to. On the other hand, deformations of the recording medium 120 may be produced by the web tensile force that, at the output of the printer 100, after the deformations have at least partially reverted again, may lead to distortions of the print image on the recording medium 120.

In an exemplary embodiment, the method 400 includes the production 401 of a web tensile force on the recording medium 120 between the first clamp 131 and the second clamp 132 via driving of the recording medium 120 by the first clamp 131 and/or by the second clamp 132. In particular, the recording medium 120 may be driven in the transport direction 1 by the second clamp 132. Alternatively or additionally, the recording medium 120 may be driven counter to the transport direction 1 by the first clamp 131.

In particular, the driving of the recording medium 120 may be produced via rotation of at least one of the rollers of the second clamp 132. For example, the recording medium 120 may be held at least in part by the first clamp 131 and be pulled by the second clamp 132. The web tensile force may be produced in advance, before the beginning of printing, or during the printing operation.

In an exemplary embodiment, the method 400 additionally includes the detection 402 of driving information with regard to the driving of the recording medium 120. In particular, driving information may be determined with regard to the rotation of the at least one roller of the second clamp 132. The driving information may in particular indicate a path or a route that the roller—in particular the surface of the roller—of the second clamp 132 has traveled in order to apply the web tensile force (typically starting from a state in which specifically no web tensile force is applied). The traveled route may, for example, be determined by a rotary sensor at the roller of the second clamp 132 and/or by a rotary sensor 201 at a dedicated rotary sensor roller of the printer 100. The traveled route indicates the conveyance route or conveyance length of the recording medium 120 that was conveyed by the second clamp 132 in order to develop the web tensile force.

In an exemplary embodiment, alternatively or additionally, the driving information may indicate the velocity of the roller of the second clamp 132, as well as possibly the velocity of a roller of the first clamp 131, which velocities are present if the web tensile force is applied (and if the recording medium 120 is conveyed or driven via the clamps 131, 132). The velocity may thereby include a tangential velocity and/or an angular velocity of a roller. The consideration of the velocity of a roller enables the deformation of a recording medium 120 to be determined, and if necessary to be compensated, during the printing operation.

In an exemplary embodiment, the method 400 additionally includes the determination 403 of stretching information with regard to a stretching ε of the recording medium 120 between the first clamp 131 and the second clamp 132 on the basis of the driving information. In particular, the stretching ε of a recording medium 120 in the transport direction 1 of a printer 100 may be precisely determined on the basis of the traveled route and/or on the basis of the roller velocity. The method 400 thus enables an efficient and precise determination of the deformation of a recording medium 120 directly within the printer 100.

A method 400 is thus described in which the clamps 131, 132 of a printer 100 are used to determine the deformation of a recording medium 120 due to the web tensile force produced in said printer 100. The deformation may thereby be determined in advance of a printing process, and/or during the printing operation. Furthermore, the determined deformation may be used to adapt a print image to be printed in order to compensate for effects of the deformation of the recording medium 120 on the print image on said recording medium 120.

The recording medium 120 may be fixed by the first clamp 131 if the web tensile force is produced. For this purpose, the recording medium 120 may be fixed in the roller nip of the rollers of the first clamp 131 and the rollers of the first clamp 131 may be stopped. The driving information may then indicate a conveyance length $l_E$ or $l'_E$ of the recording medium 120, which was conveyed through the second clamp 132 to develop the web tensile force. For example, the conveyance length $l_E$ may be determined by a rotary sensor at the second clamp 132. The stretching information, in particular the stretching ε, of the recording medium 120 may then be determined on the basis of the conveyance length $l_E$ determined by the rotary sensor and on the basis of an reference length $l_0$ of the recording medium 120 between the first clamp 131 and the second clamp 132. Alternatively or additionally, the conveyance length $l'_E$ may be determined by an intermediary rotary sensor 201 at a rotary sensor roller that is arranged between the first clamp 131 and the second clamp 132. The stretching information, in particular the stretching ε, of the recording medium 120 may then be determined on the basis of the conveyance length $l'_E$ determined by the intermediary rotary sensor 201 and on the basis of an intermediary reference length $l'_0$ between the first clamp 131 and the rotary sensor roller. The reference length $l_0$ or the intermediary reference length $l'_0$ are thereby typically established by the structure of the printer 100. A precise determination of the deformation of a recording medium 120 before the beginning of printing is enabled via the fixing of the recording medium 120.

In an exemplary embodiment, the method 400 may also include the production of a plurality of different web tensile forces. Using the measures described in this document, a plurality of items of stretching information for the plurality of different web tensile forces may then be determined for the plurality of different web tensile forces. Multiple measurement points 211 may thus be determined. A correlation, in particular a characteristic force/stretching line 212 and/or a force/stretching table, between web tensile force and stretching for the recording medium 120 may then be determined on the basis of the plurality of different web tensile forces and on the basis of the plurality of items of stretching information. This correlation may then be used in the printing operation of the printer 100 in order to compensate for the print image as a result of the deformation of the recording medium 120. The printing process may be flexibly adapted via the determination of a (possibly functional) correlation.

In an exemplary embodiment, the method 400 may also include the detection of position information with regard to at least one edge of the recording medium 120 that travels in the transport direction 1 between the first clamp 131 and the second clamp 132. The position information may, for example, by detected by an optical sensor and/or by an edge sensor. A constriction of the recording medium 120 may then be determined on the basis of the position information. In an exemplary embodiment, alternatively or additionally, a transversal contraction factor for the recording medium 120 may be determined, for example using the material properties of the recording medium 120 and/or using tests. The contraction of the recording medium 120 due to the web tensile force may then be determined on the basis of the stretching information and on the basis of the transversal contraction factor. Deformations transversal to the transport direction 1 may thus also be precisely determined and compensated for.

Following the production 401 of the web tensile force, in an exemplary embodiment, the method 400 may also include the reduction of the web tensile force produced on the recording medium 120 by the first clamp 131 and/or by the second clamp 132. In particular, the web tensile force may be entirely removed. Retrodriving information with regard to a backward movement of the recording medium 120 may then be determined, such as retrodriving information with regard to a backward rotation of the at least one roller of the second clamp 132 that takes place upon reduction of the produced web tensile force. In particular, the route that the roller of the second clamp 132 travels in the reverse direction if the web tensile force is removed may be determined. This route then indicates the contraction of the recording medium 120 upon removal of the web tensile force. A dimension of the plastic deformation of the recording medium 120 may then be determined on the basis of the retrodriving information. In particular, a stretching may be determined that the recording medium 120 maintains even after removal of the web tensile force. This stretching indicates the plastic deformation of the recording medium 120 due to the web tensile force. The plastic deformation may then be taken into account in the adaptation of the print image. The accuracy of the deformation compensation may thus be further increased.

In an exemplary embodiment, the driving information may include information with regard to a first velocity $v_1$ or $\omega_1$ of at least one roller of the first clamp 131, and with regard to a second velocity $v_2$ or $\omega_2$ of at least one roller of the second clue 132. The stretching information may then be determined on the basis of a relationship of the second velocity $v_2$ or $\omega_2$ and the first velocity $v_1$ or $\omega_1$. In an exemplary embodiment, the stretching information may be determined by the following formula:

$$\varepsilon_{12} = \frac{\omega_2(r_2 + k)}{v_1} - 1$$

$\varepsilon_{12}$ is thereby the stretching of the recording medium 120 between the first clamp 131 and the second clamp 132. $\omega_2$ is the angular velocity of the roller of the second clamp 132, $r_2$ is the nominal radius of the roller of the second clamp 132, and $v_1$ is the tangential velocity of the roller of the first clamp 131. During the printing operation, the deformation of a recording medium 120 may thus be determined and compensated if necessary.

In an exemplary embodiment, the correction factor k in the above formula may be ignored. The correction factor k is thereby dependent on a pre-stretching of the recording medium 120 before or upon reaching the first clamp 131. Furthermore, the correction factor k may be dependent on a deviation $\Delta r_2$ of the radius of the roller of the second clamp 132 from the nominal radius $r_2$.

For determination of the correction factor k, in an exemplary embodiment, the method 400 may also include the determination of the velocities $v_1$ or $\omega_1$ of the roller of the first clamp 131 and the velocity $v_2$ or $\omega_2$ of the second clamp 132 for a first web tensile force $F_1$ and for a second web tensile force $F_2$. The correction factor k for compensation of manufacturing inaccuracies of the rollers of the first clamp 131 and/or of the second clamp 132, and/or in order to take into account a pre-stretching of the recording medium 120 in the transport direction 1 before or at the first clamp 131, may then be determined. In an exemplary embodiment, the determination is based on: the first web tensile force $F_1$, the second web tensile force $F_2$, the velocity $v_1$ or $\omega_1$ of the roller of the first clamp 131, and the velocity $v_2$ or $\omega_2$ of the roller of the second clamp 132. In an exemplary embodiment, the following formula may be used in order to determine the correction factor k:

$$\frac{F_2 - F_1}{F_1} = \frac{\dfrac{\omega_{2,1}}{\omega_{1,1} r_1} - \dfrac{\omega_{2,2}}{\omega_{1,2} r_1}}{\dfrac{\omega_{2,2}}{\omega_{1,2} r_1} - \dfrac{1}{(r_2 + k)}}$$

The stretching information, in particular the stretching $\varepsilon_{12}$ between the first clamp 131 and the second clamp 132, may then be determined precisely on the basis of the correction factor k. The accuracy of the determined stretching information may thus be further increased.

Furthermore, as described herein, is a method for compensation of effects of the deformation of a recording medium 120 in a printer 100. In an exemplary embodiment, the printer 100 thereby comprises a first clamp 131 that, in the transport direction 1 of the recording medium 120, is arranged before a print group of the printer 100 for printing of a print image, and a second clamp 132 that, in the transport direction 1, is arranged behind or after the print group. The second clamp 132 thereby typically comprises rollers that form a roller nip through which the recording medium 120 is directed and via which a web tensile force on the recording medium 120 may be produced so that said recording medium 120 is tensioned in the print group.

In an exemplary embodiment, the method includes the determination of stretching information with regard to a stretching of the recording medium 120 in the print group. The stretching information may, for example, be stored in a memory of the printer 100. The stretching information may indicate the deformation, in particular the stretching and/or the contraction, of a recording medium 120 for a plurality of different web tensile forces. For example, the stretching information may indicate a characteristic force/stretching line 212 of the recording medium 120.

The stored stretching information may then be accessed during a printing process. The stretching information may thereby be determined, or may have been determined, via the method 400 described in this document. In particular, the stretching information may have been detected before a printing process and/or may be determined during a printing process. Alternatively or additionally, the stretching information may have been determined in advance, for example with the scope of a pull test at a material testing machine, and have been stored at the printer 100.

Moreover, in an exemplary embodiment, the method includes the adaptation of a print image to be printed by the print group, depending on the stretching information. In particular, the dimensions of a print image to be printed may thereby be adapted in order to ensure that the print image has the desired target dimensions after relaxation of the recording medium 120 at the output of the printer 100.

Within the scope of the adaptation of the print image to be printed, the current web tensile force on the recording medium 120 may initially be determined, for example, by a force sensor of the printer 100. The current deformation, in particular the current stretching, of the recording medium 120 at the current web tensile force may then be determined on the basis of the stretching information, in particular on the basis of a characteristic force/stretching line 212. In an exemplary embodiment, the print image to be printed may then be adapted based on the current deformation, in particular, based on the current stretching.

In an exemplary embodiment, the method to compensate for effects of the deformation of a recording medium 120 may also include the determination of time information with regard to a traversal time of the recording medium 120 through the print group. In particular, the traversal time of a specific segment of the recording medium 120 from the first clamp 131 to the second clamp 132 may be determined. The print image to be printed may then also be adapted depending on the time information. In particular, the deformation of the recording medium 120 may be determined on the basis of the time information and be taken into account in the adaptation of the print image to be printed. In particular, time-dependent deformation effects such as creep may be taken into account and compensated for via the consideration of the time information. The print quality of the recording medium 120 may thus be further increased.

Furthermore, described in this document is a device, in particular a printer 100, that is set up to execute one or more of the methods described in this document.

The measures described in this document enable the deformation of a recording medium 120 in a printer 100 to be determined precisely even without printing of a marking. Additional printing modules and readout modules may thus be spared. Furthermore, interfering markings on the recording medium 120 may be avoided. Moreover, the susceptibility to error in the evaluation of a printed marking may be avoided. The described measures enable unknown types of recording media 120 to be printed to. Moreover, the consideration of plastic deformation is enabled. Furthermore, a temporal dependency of the deformation may be taken into account, which may be relevant given the variation of the printing speed or the web length, or given fluctuations in the material properties of a specific type of recording medium 120 (from roll to roll or within a roll), for example. In particular, fluctuations of the material properties between two or more different rolls of the recording medium 120 may be taken into account. Furthermore, fluctuations of the material properties within a single roll of the recording medium 120 (for example between a roll start and a roll end) may also be taken into account.

The described measures enable disruptions to be directly compensated for in the printing operation. Furthermore, the compensation process may be accelerated and implemented at reduced costs via the determination of the deformation of a recording medium 120 within a printer 100. Moreover, the deformation of a recording medium 120 in the transport direction 1 and/or transversal to the transport direction 1 may be detected and variably compensated for in the operation of the printer 100 via the described measures.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, "processor circuitry" can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
100 printer
101 controller of the printer 100
102 print bar
103 print head
104 nozzle
110 sensor
120 recording medium
131 first clamp
132 second clamp
201 rotary sensor
211 measurement point
212 characteristic force/stretching line
311-312 measurement point
400 method to determine the stretching of a recording medium
401-402 method steps

The invention claimed is:

1. A method to determine a deformation of a recording medium in a printer including a first clamp before a print group of the printer and a second clamp after the print group, with respect to a transport direction, the method comprising:

producing a web tensile force on the recording medium, between the first clamp and the second clamp, via driving of the recording medium by the first clamp and/or the second clamp, wherein the first clamp and the second clamp respectively include at least one roller;

determining first velocities of the roller of the first clamp for a first web tensile force and for a second web tensile force;

determining second velocities of the roller of the second clamp for the first web tensile force and for the second web tensile force;

determining a correction factor based on the first web tensile force, the second web tensile force, the first velocities of the roller of the first clamp, and the second velocities of the roller of the second clamp; and determining stretching information with regard to a stretching of the recording medium between the first clamp and the second clamp based on a relationship of the second velocity to the first velocity given identical web tensile forces, and based on the correction factor.

2. The method according to claim 1, wherein the correction factor is determined under a boundary condition that includes:

the stretching of the recording medium is zero for a web tensile force of zero; and/or a correlation between web tensile force and stretching for the recording medium is a straight line.

3. The method according to claim 1, wherein the correction factor is determined such that:

$$\frac{F_2 - F_1}{F_1} = \frac{\dfrac{\omega_{2,1}}{\omega_{1,1} r_1} - \dfrac{\omega_{2,2}}{\omega_{1,2} r_1}}{\dfrac{\omega_{2,2}}{\omega_{1,2} r_1} - \dfrac{1}{(r_2 + k)}},$$

where k is the correction factor, $F_1$ and $F_2$ are the first or second web tensile force, $r_1$ and $r_2$ are a nominal radius of the roller of the first clamp or of the second clamp, $\omega_{2,1}$ is a second angular velocity of the roller of the second clamp for the first web tensile force, $\omega_{1,1}$ is a first angular velocity of the roller of the first clamp for the first web tensile force, $\omega_{2,2}$ is a second angular velocity of the roller of the second clamp for the second web tensile force, and $\omega_{1,2}$ is a first angular velocity of the roller of the first clamp for the second web tensile force.

4. The method according to claim 1, wherein the stretching information is determined such that:

$$\varepsilon_{12} = \frac{\omega_2 (r_2 + k)}{v_1} - 1,$$

where $\varepsilon_{12}$ is the stretching of the recording medium between the first clamp and the second clamp, k is the correction factor, $r_2$ is a nominal radius of the roller of the second clamp, and $\omega_2$ is a second angular velocity of the roller of the second clamp and $v_1$ is a first tangential velocity of the roller of the first clamp for a same web tensile force.

5. The method according to claim 1, further comprising:

producing a plurality of different web tensile forces;

determining a plurality of items of stretching information for the plurality of different web tensile forces; and determining a correlation between web tensile force and stretching for the recording medium based on the plurality of different web tensile forces and the plurality of items of stretching information.

6. The method according to claim 1, further comprising:

detecting position information with regard to at least one edge of the recording medium that travels between the first clamp and the second clamp;

determining a contraction of the recording medium based on the position information; and/or determining a transversal contraction factor for the recording medium; and determining a contraction of the recording medium based on the stretching information and the transversal contraction factor.

7. The method according to claim 1, further comprising:

detecting position information with regard to at least one edge of the recording medium that travels between the first clamp and the second clamp;

determining a contraction of the recording medium based on the position information;

determining a transversal contraction factor for the recording medium; and determining a contraction of the recording medium based on the stretching information and the transversal contraction factor.

8. The method according to claim 1, further comprising:

following the production of the web tensile force, reducing the produced web tensile force on the recording medium;

detecting retrodriving information with regard to a reverse movement of the recording medium that takes place upon reduction of the produced web tensile force; and determining a measurement of a plastic deformation of the recording medium based on the retrodriving information.

9. The method according to claim 1, wherein the correction factor:

compensates for manufacturing inaccuracies of the rollers of the first clamp and/or of the second clamp, and/or takes into account a pre-stretching of the recording medium before the first clamp.

10. The method according to claim 1, further comprising:

adapting a print image to be printed by the print group based on the stretching information.

11. The method according to claim 10, further comprising:

determining time information with regard to a traversal time of the recording medium through the print group, wherein the print image to be printed is also adapted based on the time information.

12. A non-transitory computer-readable storage medium with an executable program stored thereon, that when executed, causes a processor to perform the method of claim 1.

13. A printer adapted to determine a deformation of a recording medium, comprising:

a first clamp;

a print group positioned after the first clamp in a transport direction;

a second clamp positioned after the print group in the transport direction; and a controller that is configured to:

control the first and/or second clamps to drive the recording medium to produce a web tensile force on the recording medium, wherein the first clamp and the second clamp respectively include at least one roller;

determine first velocities of the roller of the first clamp for a first web tensile force and for a second web tensile force;

determine second velocities of the roller of the second clamp for the first web tensile force and for the second web tensile force;

determine a correction factor based on the first web tensile force, the second web tensile force, the first velocities of the roller of the first clamp, and the second velocities of the roller of the second clamp; and determine stretching information with regard to a stretching of the recording medium between the first clamp and the second clamp based on a relationship of the second velocity to the first velocity given identical web tensile forces, and based on the correction factor.

14. The printer according to claim 13, wherein the correction factor:

compensates for manufacturing inaccuracies of the rollers of the first clamp and/or of the second clamp, and/or takes into account a pre-stretching of the recording medium before the first clamp.

* * * * *